US011253410B2

(12) United States Patent
Huang

(10) Patent No.: US 11,253,410 B2
(45) Date of Patent: Feb. 22, 2022

(54) MOBILITY ASSISTIVE DEVICE AND CONNECTING STRUCTURE FOR MOBILITY ASSISTIVE DEVICE

(71) Applicant: Tung Keng Enterprise Co., Ltd., Taichung (TW)

(72) Inventor: Chia-Yen Huang, Taichung (TW)

(73) Assignee: TUNG KENG ENTERPRISE CO., LTD., Taichung (TW)

( * ) Notice: Subject to any disclaimer, the term of this patent is extended or adjusted under 35 U.S.C. 154(b) by 258 days.

(21) Appl. No.: 16/674,362

(22) Filed: Nov. 5, 2019

(65) Prior Publication Data

US 2021/0128379 A1 May 6, 2021

(51) Int. Cl.
*A61G 5/08* (2006.01)
*A61G 5/10* (2006.01)

(52) U.S. Cl.
CPC ..... *A61G 5/0875* (2016.11); *A61G 5/1083* (2016.11); *A61G 5/1089* (2016.11)

(58) Field of Classification Search
CPC ..... A61G 5/0875; A61G 5/1089; A61G 5/047
See application file for complete search history.

(56) References Cited

U.S. PATENT DOCUMENTS 4,362,311 A * 12/1982 Bergman ..... A61G 5/00 280/250.1
4,643,446 A * 2/1987 Murphy ..... A61G 3/06 180/11
5,154,251 A * 10/1992 Fought ..... B62D 61/08 180/208
5,291,959 A * 3/1994 Malblanc ..... A61G 5/047 180/11
6,135,222 A * 10/2000 Furukawa ..... A61G 5/043 180/65.51
7,252,168 B2 * 8/2007 Lin ..... B62D 63/025 180/208
7,275,608 B2 * 10/2007 Lo ..... B62K 5/025 180/11
9,440,690 B2 * 9/2016 Manternach ..... B62D 21/11
9,474,665 B1 * 10/2016 Chan ..... A61G 5/125
10,588,796 B2 * 3/2020 Bach Castillo ..... B62K 5/023

* cited by examiner

*Primary Examiner* — Minnah L Seoh
*Assistant Examiner* — Harold Eric Pahlck, III
(74) *Attorney, Agent, or Firm* — Tracy Heims; Apex Juris, pllc.

(57) ABSTRACT

A mobility assistive device includes a first frame including a first support and a first wheel, a second frame including a second support and second wheels, and a connecting structure including first connecting boards connected to the first support. The second support includes a supporting rod and abutting portions. Each first connecting board has a slot for being engaged with the supporting rod, an abutting surface for abutting against the abutting portions, and a perforation. Each positioning member is disposed on one the second support, and includes a positioning portion. When the slots are engaged with the supporting rod and the abutting surfaces are abutted against the abutting portions, the positioning portions are movable between a locked position and a released position. When in the locked position, the positioning portions are inserted into the perforations. When in the released position, the positioning portions are drew out from the perforations.

15 Claims, 9 Drawing Sheets

MOBILITY ASSISTIVE DEVICE AND CONNECTING STRUCTURE FOR MOBILITY ASSISTIVE DEVICE

TECHNICAL FIELD

The present invention relates generally to a mobility assistive device, and more particularly to an easily-dissembled and easily-assembled mobility assistive device.

DESCRIPTION OF RELATED ART

Due to aging, injury, or some other reasons, a lot of people need a mobility assistive device in order to move conveniently or to rehabilitate. On the market, the mobility assistive devices, such as a walker and wheelchair, are very common. Take the walker as an example, the walker usually includes a frame and a wheel assembly. The frame is adapted to support a weight of a user's body and to be held by the user to help the user keep balance during walking. Moreover, the walker having the wheel assembly could even help the user move more easily. As for wheelchair, except the frame and the wheel assembly, it usually includes a seat for the user to sit.

In order to provide a good support for the user, generally, the aforementioned mobility assistive device is very large, so that it is not easy to carry or to deliver. Although some mobility assistive device could be detached or be folded, the structure is usually complicated, so that the user wastes too much time on assembling the device. As a result, the conventional mobility assistive device still has room for improvement.

BRIEF SUMMARY OF THE INVENTION

In view of the above, the primary objective of the present invention is to provide a mobility assistive device and a connecting structure for a mobility assistive device, so that a user could detach or assemble the mobility assistive device easily through the connecting structure.

The present invention provides a mobility assistive device including a first frame, a second frame, and a connecting structure. The first frame includes a first support and at least one first wheel, wherein the at least one first wheel is pivotally connected to the first support. The second frame includes a second support and two second wheels, wherein the two second wheels are pivotally connected to the second support. The second support includes at least one supporting rod and two abutting portions. The first frame is detachably connected to the second frame via the connecting structure, and the connecting structure includes two first connecting boards and two positioning members, wherein the two first connecting boards are connected to the first support and each of the two first connecting boards has a slot, an abutting surface, and a perforation. Each of the slots is adapted to be engaged with the at least one supporting rod. Each of the abutting surfaces is adapted to be abutted against one of the two abutting portions. The two positioning members are disposed on the second support, and each of the two positioning members includes a positioning portion. When each of the slots is engaged with the at least one supporting rod and each of the abutting surfaces abuts against one of the two abutting portions, each of the positioning portions is movable between a locked position and a released position. When the positioning portions are in the locked position, each of the positioning portions is inserted into one of the perforations; when the positioning portions are in the released position, each of the positioning portions is drew out from the corresponding perforation.

The present invention provides a connecting structure for a mobility assistive device, wherein the mobility assistive device includes a first support, a second support, and a plurality of wheels. The first support is detachably connected to the second support by the connecting structure. The second support includes the at least one supporting rod and two abutting portions. The plurality of wheels are respectively connected to the first support and the second support. The connecting structure includes two first connecting boards and two positioning members. The two first connecting board are connected to the first support, wherein each of the two first connecting boards has a slot, an abutting surface, and a perforation. Each of the slots is engaged with the at least one supporting rod. Each of the abutting surfaces is adapted to abut against one of the two abutting portions. The two positioning members are disposed on the second support, wherein each of the two positioning members includes a positioning portion. When each of the slots is engaged with the at least one supporting rod and each of the abutting surfaces abuts against one of the two abutting portions, each of the positioning portions is movable between a locked position and a released position. When the positioning portions are in the locked position, each of the positioning portions is inserted into one of the perforations; when the positioning portions are in the released position, each of the positioning portions is drew out from the corresponding perforation.

With the aforementioned design, the connection between the first support of the first frame and the second support of the second frame via the connecting structure is detachable. When the user is about to engage the first support and the second support, the user only needs to engage each of the slots and the at least one supporting rod and to abut each of the two abutting surfaces against one of the two abutting portions, and to move each of the positioning portions to the locked position to complete the engagement between first support and the second support. In contrary, when the user is about to disassembled the first support and the second support, the user only needs to switch the positioning portions to the released position, and to disengage the slots and the at least one supporting rod and to disengage the abutting surfaces and the abutting portions by moving the first support to drive the first connecting boards connected to the first support to move, thereby the first support and the second support are successfully disassembled. In this way, the user could easily disassemble or to assemble the first frame and the second frame without additional tools, such as the screwdriver or wrench, so that the mobility assistive device is convenient for carrying or storage.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
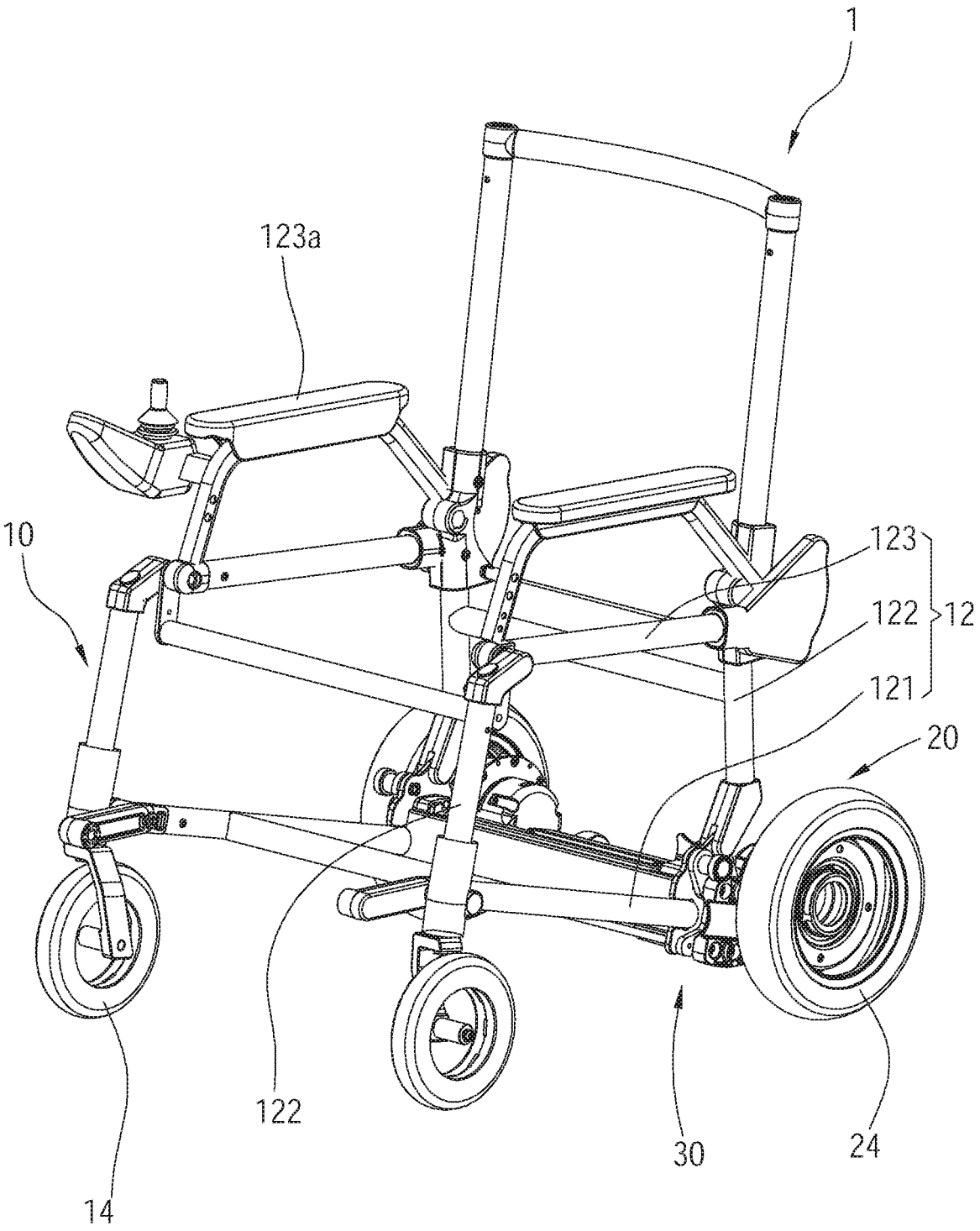
FIG. 1 is a perspective diagram of the mobility assistive device of an embodiment according to the present invention.
Figure 2:
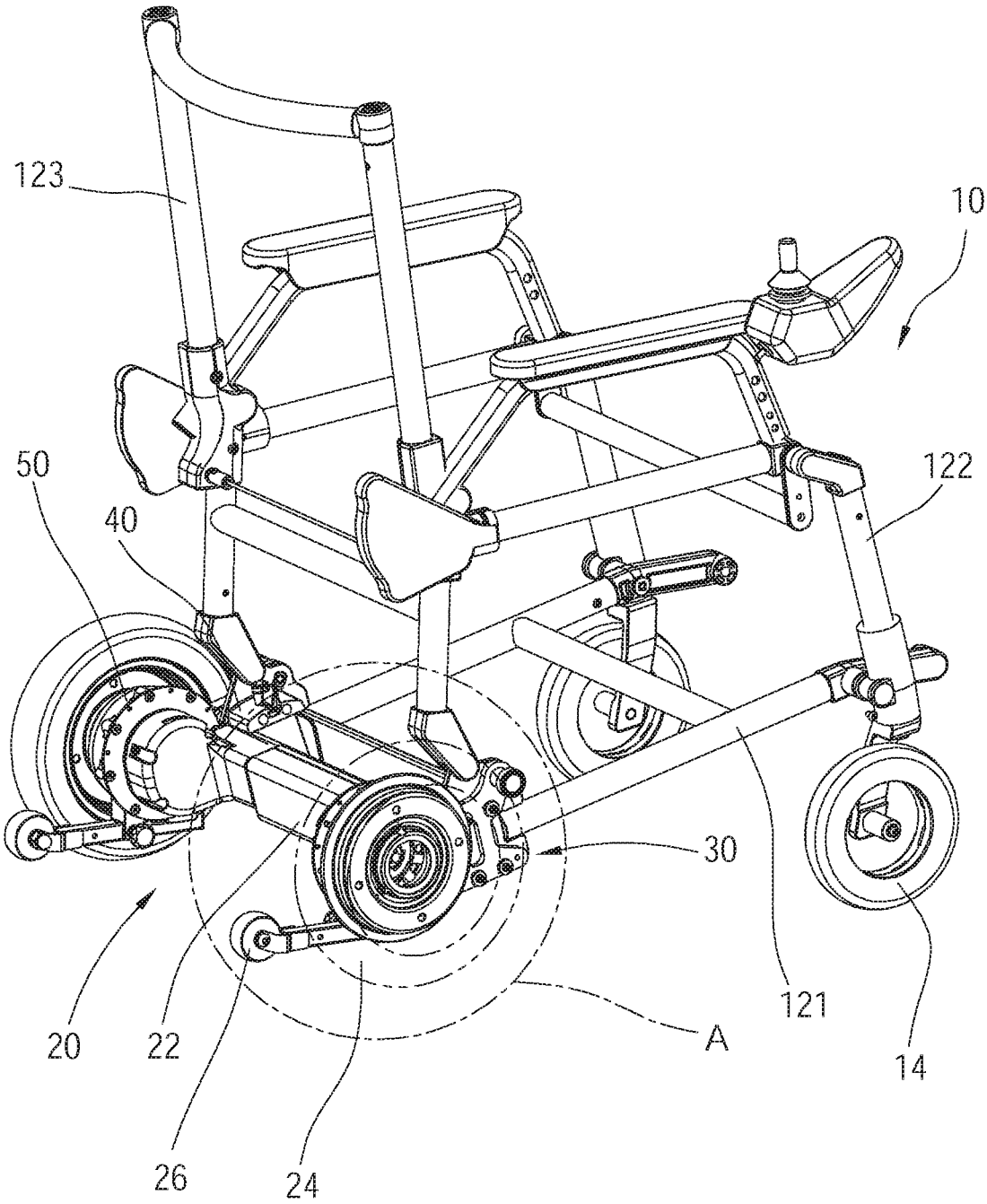
FIG. 2 is a perspective diagram, showing the mobility assistive device of said embodiment according to the present invention in another direction.
Figure 3:
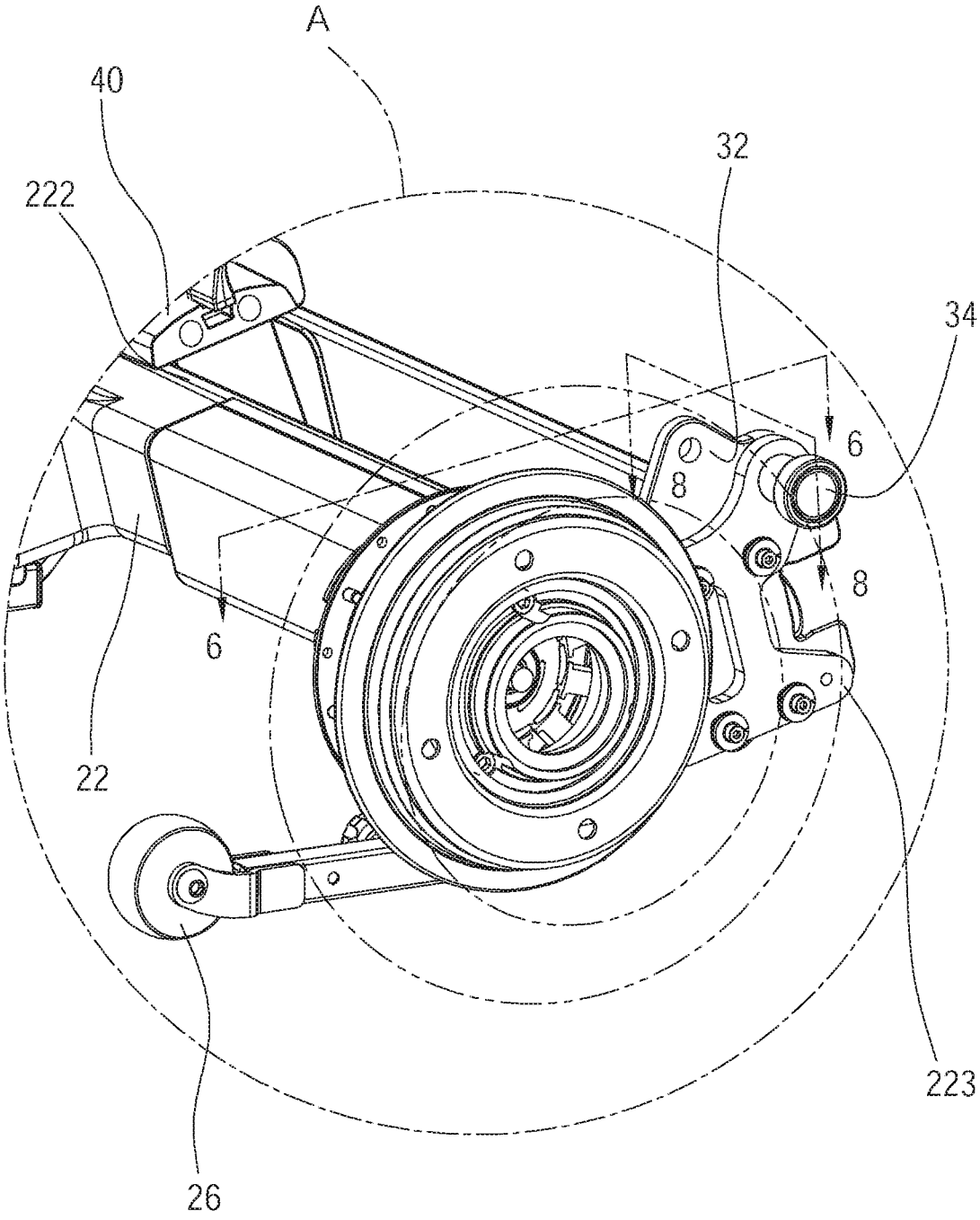
FIG. 3 is an enlarged partial diagram of the marked A region in FIG. 2.
Figure 4:
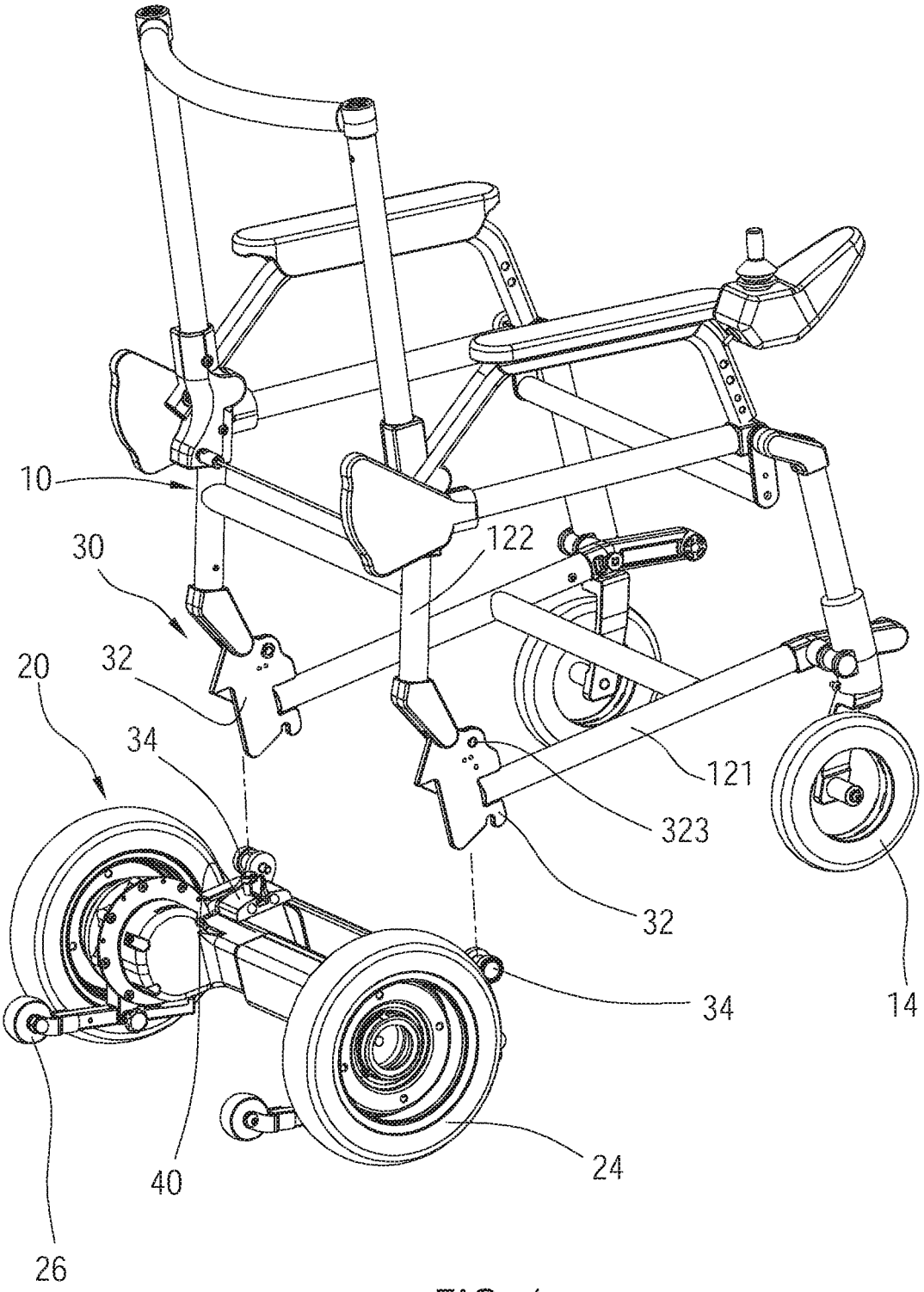
FIG. 4 is a schematic diagram, showing partial components of the mobility assistive device of said embodiment are disassembled.
Figure 5:
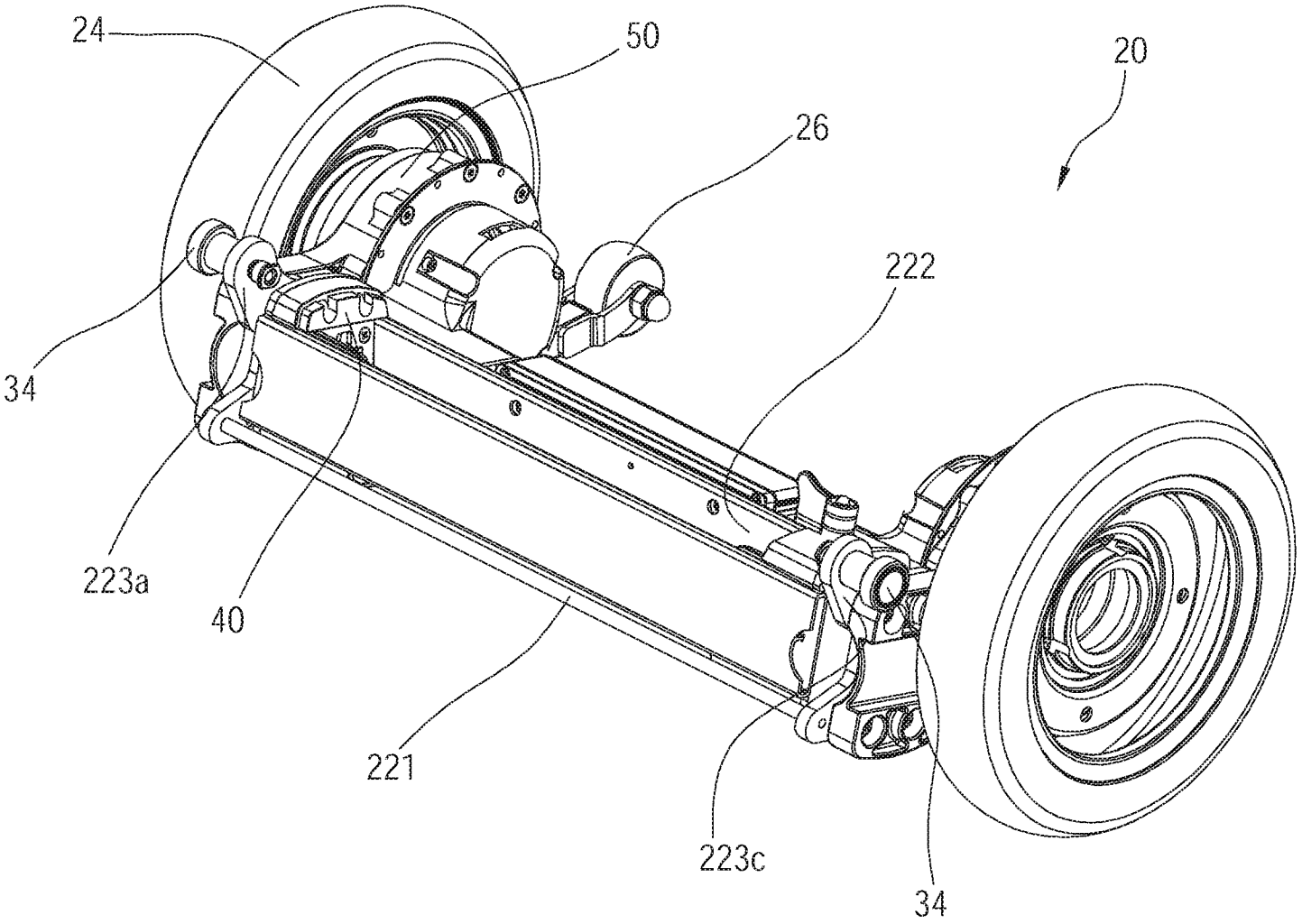
FIG. 5 is a schematic diagram, showing the second frame of said embodiment.

As illustrated in FIG. 1 to FIG. 9, a mobility assistive device 1 of an embodiment according to the present invention is an electric wheelchair as an example. It's not limited to the electric wheelchair in other embodiments. For instance, said mobility assistive device could be a manual wheelchair, a walker, or other mobility assistive devices. In the current embodiment, the mobility assistive device 1 includes a first frame 10, a second frame 20, and a connecting structure 30. The first frame 10 is detachably connected to the second frame 20 via the connecting structure 30.

The first frame 10 includes a first support 12 and two first wheels 14. The first support 12 includes a bottom bar assembly 121, a side bar assembly 122, and an upper bar assembly 123. In the current embodiment, the side bar assembly 122 includes two front bars and two rear bars, wherein both of the front bars and the rear bars are connected to the bottom bar assembly 121 and the upper bar assembly 123. The two first wheels 14 are pivotally connected to the front bars of the side bar assembly 122 of the first support 12. In other embodiment, the number of the first wheel 14 could be one. Preferably, a chair cushion, a backrest, and armrests 123*a* could be mounted on the upper bar assembly 123 of the first support 12, so that a user could sit on, lean against, or put arms on the upper bar assembly 123. The rear bars of the side bar assembly 122 is closer to the backrest than the front bars.

The second frame 20 includes a second support 22 and two second wheels 24. The two second wheels 24 are pivotally connected to the second support 22. The second support 22 includes a supporting rod 221, a beam 222, and two second connecting boards 223, wherein each of the two second connecting boards 223 has an inner side 223*a* and an outer side 223*c* which is opposite to the inner side 223*a*. The supporting rod 221 is a cylinder, and two ends of the supporting rod 221 are respectively connected to the inner side 223*a* of each of the two second connecting boards 223. In other embodiment, the number of the supporting rod 221 could be two. Two ends of each of the two supporting rods are respectively connected to the inner side 223*a* of the two second connecting boards 223. Two ends of the beam 222 are respectively connected to the inner side 223*a* of the two second connecting boards 223. The beam 222 has two abutting portions 222*a* on a top thereof. In the current embodiment, the two abutting portions 222*a* are flat surfaces. Moreover, the mobility assistive device 1 further includes a battery holder 40 and two motors 50. A side of the battery holder 40 abuts against the top surface of the beam 222, and the battery holder 40 is adapted to install a battery for providing electricity to activate the two motors 50. The two motors 50 are disposed on the second support 22 and are respectively connected to the two second wheels 24 to respectively drive the two second wheels 24 to rotate.

The connecting structure 30 includes two first connecting boards 32 and two positioning members 34. Each of the two first connecting boards 32 is connected to one of the rear bars of the side bar assembly 122 and the bottom bar assembly 121 of the first support 12, and has a slot 321, an abutting surface 322, and a perforation 323. Each of the slots 321 is formed by recessing into an outer periphery of one of the two first connecting boards 32 and is adapted to abut against the supporting rod 221. In the current embodiment, the supporting rod 221 is stuck into each of the slots 321. Besides, a wall of each of the slots 321 has a slanted surface 321*a*, and each of the slanted surfaces 321*a* is tilted upward from the rear bars of the side bar assembly 122 toward the front bars of the side bar assembly 122 and is connected to an inner surface 321*b* of the slots 321, wherein the inner surface 321*b* of the slots 321 is a curved surface, thereby when each of the slots 321 is engaged with the supporting rod 221, the supporting rod 221 could slide into the inner surfaces 321*b* of the slots 321 along the slanted surface 321*a*. Therefore, the slanted surface 321*a* of each of the slots 321 facilitates the supporting rod 221 aligning and engaging quickly with the slots 321. The abutting surface 322 of each of the two first connecting boards 32 is formed by recessing into an outer periphery of one of the two first connecting boards 32, and each of the abutting surfaces 322 is a flat surface which is corresponding to the two abutting portions 222*a*. Each of the abutting surfaces 322 is adapted to abut against one of the two abutting portions 222*a* of the beam 222. Practically, each of the abutting surfaces 322 could be a curved surface as well, and each of the two abutting portions 222*a* is a curved surface which is complementary to the curved surface of one of the abutting surfaces 322. For example, each of the abutting surfaces 322 is a concave surface, and one of the two abutting portions 222*a* is a complementary convex surface correspondingly, and vice versa. In this way, each of the abutting surface 322 could be firmly abutted against one of the two abutting portions 222*a* of the beam 222.

The two positioning members 34 are respectively disposed on the two second connecting boards 223 of the second support 22. Each of the two positioning members 34 includes a positioning portion 341 and a main body 342, and each of the main bodies 342 is connected to the outer side 223*c* of one of the two second connecting boards 223. The two first connecting boards 32 are located between the inner sides 223*a* of the two second connecting boards 223. When each of the slots 321 is engaged with the supporting rod 221 and each of the abutting surfaces 322 abuts against one of the two abutting portions 222*a*, the user could manipulate the main body 342 of each of the two positioning members 34 to move the positioning portion 341 between a locked position PL and a released position PR. When each of the positioning portion 341 is in the locked position PL, each of the positioning portion 341 is inserted through a through hole 223*b* of one of the two second connecting boards 223 and is inserted into the perforation 323 on one of the two first connecting boards 32 to firmly engage the first support 12 of the first frame 10 and the second support 22 of the second frame 20. When each of the positioning portion 341 is in the released position PR, each of the positioning portions 341 is drew out from the perforation 323 on one of the two first connecting boards 32, so that the user could disassemble the first support 12 of the first frame 10 and the second frame 20.

It is worthy to mention that the second frame 20 further includes two anti-tilt rods 26 located on a side of the second frame 20 which is opposite to a side of the second frame 20 facing the first frame 10. In other embodiments, the number of the anti-tilt rod could be one.

Figure 6:
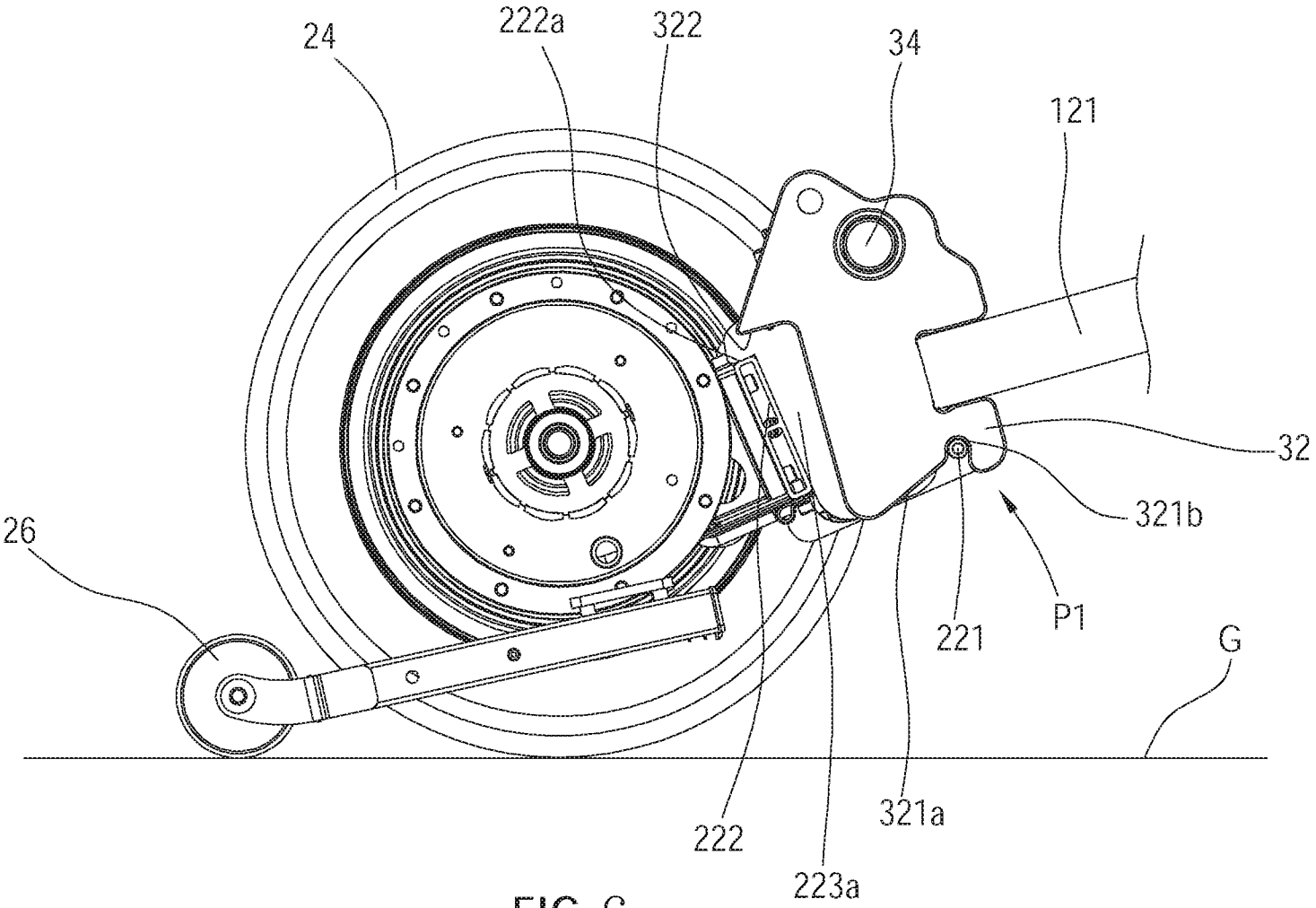
FIG. 6 is a sectional diagram taken along the 6-6 line in FIG. 3.
Figure 7:
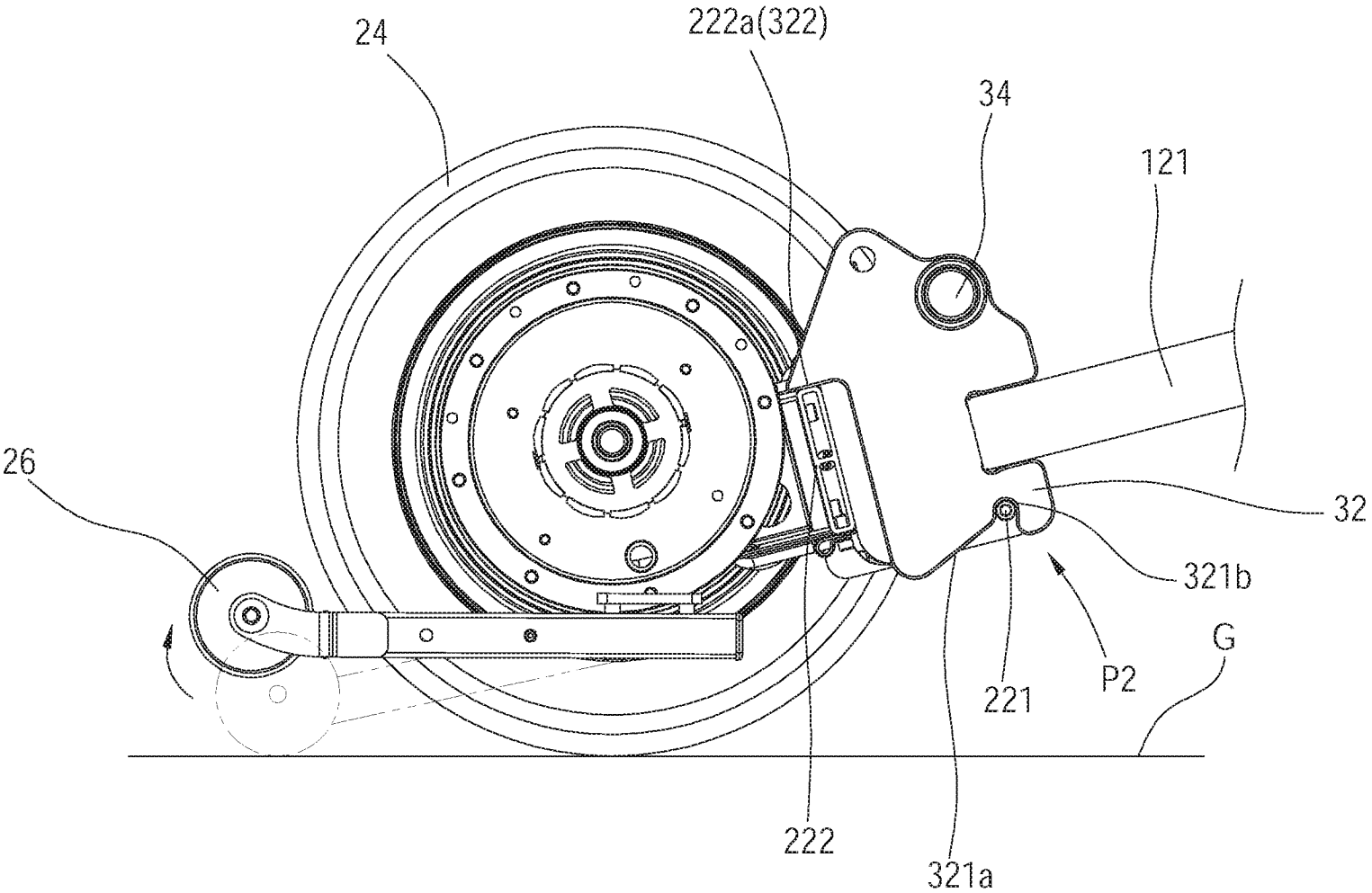
FIG. 7 is a schematic diagram, showing the first frame of said embodiment is in the second position.
Figure 8:
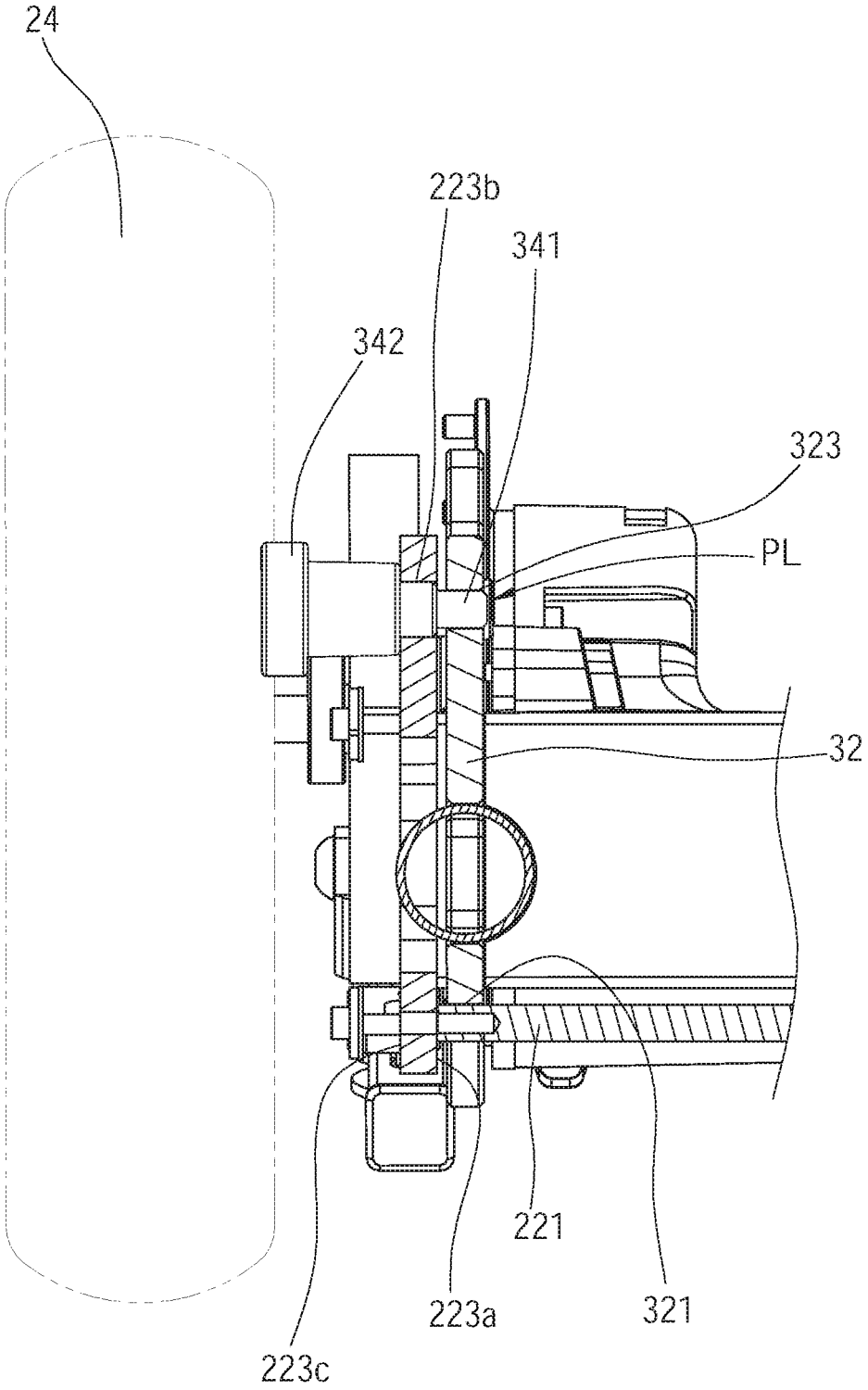
FIG. 8 is a sectional diagram taken along the 8-8 line in FIG. 3.
Figure 9:
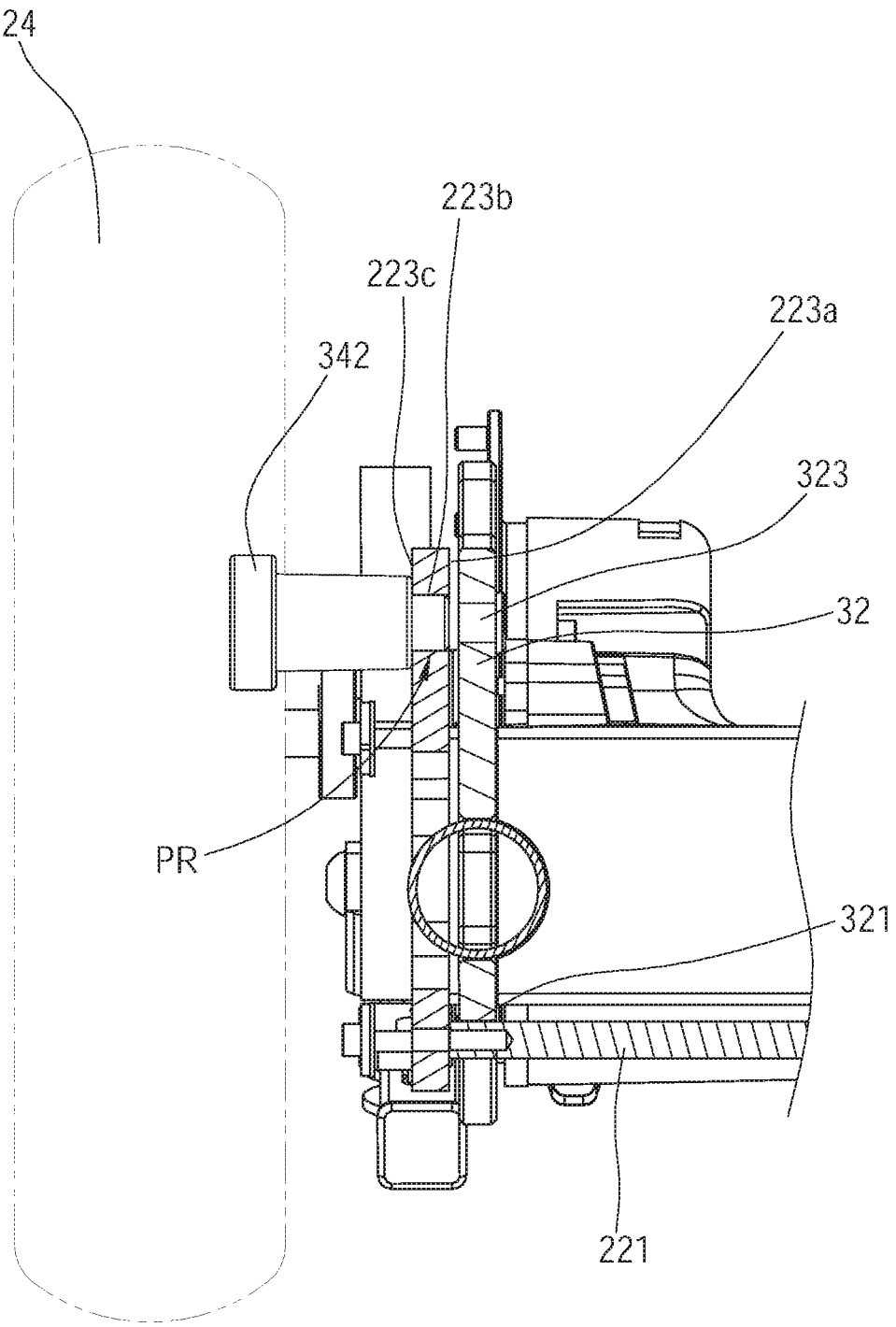
FIG. 9 is a schematic diagram, showing the positioning portions of said embodiment are moved to the released position.

Referring to the FIG. 6, when the first frame 10 is detached from the second frame 20, the supporting rod 221 and each of the two abutting portions 222*a* are located in a first position P1. At this time, the two anti-tilt rods 26 and the two second wheels 24 leans against to a bearing surface G. When the first frame 10 is engaged with the second frame 20, as shown in FIG. 7, the supporting rod 221 and each of the two abutting portions 222*a* are pressed to be located in a second position P2. At this time, the two anti-tilt rods 26 leave the bearing surface G. The second position P2 is lower than the first position P1. In other words, when the first frame 10 is separated from the second frame 20, a center of weight of the second frame 20 trends to the rear bars, allowing the supporting rod 221 and the two abutting portions 222*a* to move up to the first position P1, which is convenient for the user to align the supporting rod 221. In addition, the two anti-tilt rods 26 could also facilitate the second frame 20 to stably stay on the bearing surface G, which facilitates the user to assemble the first frame 10 and the second frame 20.

The supporting rod 221 moves upward, so that the user could firmly engage the first support 12 of the first frame 10 and the second support 22 of the second frame 20 by simply moving each of the two first connecting boards 32, which is connected to the first support 12, close to the inner side 223*a* of one of the two second connecting boards 223 of the second support 22, and abutting the slot 321 of each of the two first connecting boards 32 against the supporting rod 221, and abutting the abutting surface 322 of each of the two first connecting boards 32 against the beam 222, and pressing down the supporting rod 221 and the two abutting portions 222*a* to the second position P2, and then manipulating the main body 342 of each of the two positioning members 34, which is located on the outer side 223*c* of one of the two second connecting boards 223 in accordance with the aforementioned way to insert the positioning portion 341 of each of the two positioning members 34 into the perforation 323 of one of the two first connecting board 32 (i.e., switch each of the positioning portions 341 to the locked position PL).

In contrast, when the user is about to take apart the first support 12 of the first frame 10 and the second support 22 of the second frame 20, the user only need to adjust the positioning portion 341 to the released position PR, and then to move the first support 12 to drive each of the two first connecting boards 32 connected to the first support 12, so that each of the slots 321 leaves the supporting rod 221 and each of the abutting surfaces 322 leaves the corresponding abutting portion 222*a*, thereby the first support 12 of the first frame 10 is disassembled from the second support 22 of the second frame 20, and the supporting rod 221 and each of the two abutting portions 222*a* return to the first position P1 again. In this way, the user doesn't need additional tools (e.g. screwdriver, wrench, and so on) to disassemble or to assemble the first frame and the second frame, and that facilitates delivery or storage.

It must be pointed out that the embodiment described above is only a preferred embodiment of the present invention. All equivalent structures which employ the concepts disclosed in this specification and the appended claims should fall within the scope of the present invention.

What is claimed is:

1. A mobility assistive device, comprising:

a first frame comprising a first support and at least one first wheel, wherein the at least one first wheel is pivotally connected to the first support;

a second frame comprising a second support and two second wheels, wherein the two second wheels are pivotally connected to the second support; the second support comprises at least one supporting rod and two abutting portions; and a connecting structure, wherein the first frame is detachably connected to the second frame via the connecting structure, and the connecting structure comprises two first connecting boards and two positioning members;

wherein the two first connecting boards are connected to the first support, and each of the two first connecting boards has a slot, an abutting surface, and a perforation; each of the slots is adapted to be engaged with the at least one supporting rod; each of the abutting surfaces is adapted to be abutted against one of the two abutting portions;

wherein the two positioning members are disposed on the second support, and each of the two positioning members comprises a positioning portion; when each of the slots is engaged with the at least one supporting rod and each of the abutting surfaces abuts against one of the two abutting portions, each of the positioning portions is movable between a locked position and a released position; when the positioning portions are in the locked position, each of the positioning portions is inserted into one of the perforations; when the positioning portions are in the released position, each of the positioning portions is drew out from the corresponding perforation;

wherein the second support comprises two second connecting boards; two ends of the at least one supporting rod are respectively connected to the two second connecting boards; each of the two positioning members is disposed on one of the two second connecting boards;

wherein each of the two second connecting boards has an inner side and an outer side which is opposite to the inner side; the two first connecting boards are located between the inner sides of the two second connecting boards; each of the two positioning members comprises a main body, and each of the main bodies is connected to the outer side of one of the two second connecting boards; when the positioning portions are in the locked position, each of the positioning portions is inserted through a through hole on one of the two second connecting boards and is inserted into the perforation on one of the two first connecting boards.

2. The mobility assistive device of claim 1, wherein the second support comprises a beam; two ends of the beam are respectively connected to the two second connecting boards; the beam has the two abutting portions which are adapted to be abutted by the two abutting surfaces.

3. The mobility assistive device of claim 2, wherein each of the two abutting portions of the beam is a flat surface, and each of the two abutting surfaces is a flat surface.

4. The mobility assistive device of claim 2, wherein each of the two abutting portions of the beam is a curved surface, each of the two abutting surfaces is a curved surface which is complementary to the curved surface of the abutting portions.

5. The mobility assistive device of claim 1, wherein the at least one supporting rod is a cylinder; each of the slots is formed by recessing into an outer periphery of one of the two first connecting boards; an inner surface of each of the slots is a curved surface and is adapted to be abutted against the at least one supporting rod.

6. The mobility assistive device of claim 1, wherein a wall of each of the slots has a slanted surface.

7. The mobility assistive device of claim 1, wherein the second frame comprises at least one anti-tilt rod; when the first frame is separated from the second frame, the at least one anti-tilt rod and the two second wheels abut against a bearing surface; when the first frame is engaged with the second frame, the at least one anti-tilt rod leaves the bearing surface.

8. The mobility assistive device of claim 7, wherein the at least one anti-tilt rod is located on a side of the second frame which is opposite to a side of the second frame facing the first frame.

9. The mobility assistive device of claim 1, wherein when the first frame is disassembled from the second frame, the at least one supporting rod and the two abutting portions are located in a first position; when the first frame is assembled with the second frame, the at least one supporting rod and the two abutting portions are pressed downward to be located in a second position; the second position is lower than the first position.

10. A connecting structure for a mobility assistive device, wherein the mobility assistive device comprises a first support, a second support, and a plurality of wheels; the first support is detachably connected to the second support by the connecting structure; the second support comprises at least one supporting rod and two abutting portions; the plurality of wheels are respectively connected to the first support and the second support; the connecting structure comprises:

two first connecting boards which are connected to the first support, wherein each of the two first connecting boards has a slot, an abutting surface, and a perforation; each of the slots is engaged with the at least one supporting rod; each of the abutting surfaces is adapted to abut against one of the two abutting portions;

two positioning members which are disposed on the second support, wherein each of the two positioning members comprises a positioning portion; when each of the slots is engaged with the at least one supporting rod and each of the abutting surfaces abuts against one of the two abutting portions, each of the positioning portions is movable between a locked position and a released position; when the positioning portions are in the locked position, each of the positioning portions is inserted into one of the perforations; when the positioning portions are in the released position, each of the positioning portions is drew out from the corresponding perforation; and wherein the second support comprises two second connecting boards and a beam; two ends of the beam are respectively connected to the two second connecting boards; the beam has the two abutting portions which are adapted to be abutted by the two abutting surfaces.

11. The connecting structure of claim 10, wherein each of the abutting surfaces is a complementary flat or a complementary curved surface corresponding to one of the two abutting portions.

12. The connecting structure of claim 10, wherein the at least one supporting rod is a cylinder; each of the slots is formed by recessing into an outer periphery of one of the two first connecting boards; an inner surface of each of the slots is a curved surface and is adapted to be abutted against the at least one supporting rod.

13. The connecting structure of claim 10, wherein a wall of each of the slots has a slanted surface.

14. The connecting structure of claim 10, wherein two ends of the at least one supporting rod are respectively connected to the two second connecting boards; each of the two positioning members is disposed on one of the two second connecting boards.

15. The connecting structure of claim 11, wherein each of the two second connecting boards has an inner side and an outer side which is opposite to the inner side; the two first connecting boards are located between the inner sides of the two second connecting boards; each of the two positioning members comprises a main body, and each of the main bodies is connected to the outer side of one of the two second connecting boards; when the positioning portions are in the locked position, each of the positioning portions is inserted through a through hole on one of the two second connecting boards and is inserted into the perforation on one of the two first connecting boards.

* * * * *